US006588959B1

(12) United States Patent
Kuo

(10) Patent No.: US 6,588,959 B1
(45) Date of Patent: Jul. 8, 2003

(54) ROTARY LIPSTICK CASE STRUCTURE

(76) Inventor: Chen-Hui Kuo, No. 191, Lu-Tung Rd., Lu-Kang Township, Chang Hua Hsien (TW)

( * ) Notice: Subject to any disclaimer, the term of this patent is extended or adjusted under 35 U.S.C. 154(b) by 0 days.

(21) Appl. No.: 10/195,682

(22) Filed: Jul. 16, 2002

(51) Int. Cl.[7] ..... B43K 5/16
(52) U.S. Cl. ..... 401/108; 401/107
(58) Field of Search ..... 401/98, 108, 107, 401/116, 117, 99; 132/317

(56) References Cited

U.S. PATENT DOCUMENTS 2,626,049 A * 1/1953 Tursky ..... 401/108
3,445,171 A * 5/1969 Seidler ..... 401/108
5,423,622 A * 6/1995 Perrotti ..... 401/59

* cited by examiner

*Primary Examiner*—David J. Walczak
(74) *Attorney, Agent, or Firm*—Harrison & Egbert

(57) ABSTRACT

A lipstick case structure includes a base on which a rotary tube is mounted in conjunction with a guide tube having a spiral guide slot. The guide tube is fitted over the rotary tube such that the guide tube moves along with the base. The rotary tube is provided at the top end with a guide seat which is fastened to a casing. A flexible cover is movably disposed between the guide tube and the casing such that a protrusion of the flexible cover is slidably received in the spiral guide slot of the guide tube, and that a protruded block of the flexible cover is slidably received in an upright guide slot of the casing. The relative rotation of the casing and the guide tube results in movement of the flexible cover to obstruct an opening of the casing, or to keep clear of the opening of the casing.

3 Claims, 8 Drawing Sheets

ROTARY LIPSTICK CASE STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lipstick, and more particularly to a rotary lipstick case structure comprising a base, a lipstick mounted on the base, and a casing for housing the lipstick. As the base is turned counterclockwise, the lipstick is extracted out of the casing. As the base is turned clockwise, the lipstick is retracted into the casing.

BACKGROUND OF THE INVENTION

As shown in FIG. 1, a rotary lipstick case of the prior art comprises a tubular cover 10, and a tubular base 11 on which a lipstick 12 is mounted. The lipstick 12 is shielded by the tubular cover 10, which must be first removed before the lipstick 12 is rolled out of the tubular base 11 for coloring the lips. The tubular cover 10 is made separately from the tubular base 11 and is therefore susceptible to being misplaced or lost. In addition, the lipstick 12 is vulnerable to being deformed by the tubular cover 10 in the event that the lipstick 12 is not rolled back into the tubular base 11 after use.

BRIEF SUMMARY OF THE INVENTION

The primary objective of the present invention is to provide a rotary lipstick case structure which is free of the drawbacks of the prior art lipstick case described above.

In keeping with the principle of the present invention, the foregoing objective of the present invention is attained by a rotary lipstick case structure comprising a base, an outer casing, an outer guide tube, a guide seat, and a flexible cover. The flexible cover is capable of moving up and down along with a lipstick mount.

The features and the advantages of the present invention will be more readily understood upon a thoughtful deliberation of the following detailed description of the present invention with reference to the accompanying drawings.

DETAILED DESCRIPTION OF THE INVENTION

Figure 1:
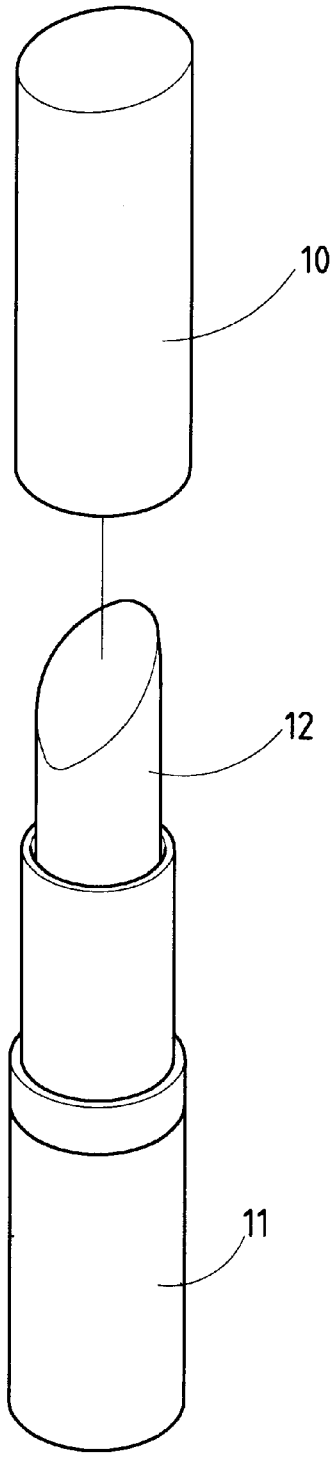
FIG.1 PRIOR ART
FIG. 1 shows a perspective view of a lipstick case of the prior art.
Figure 2:
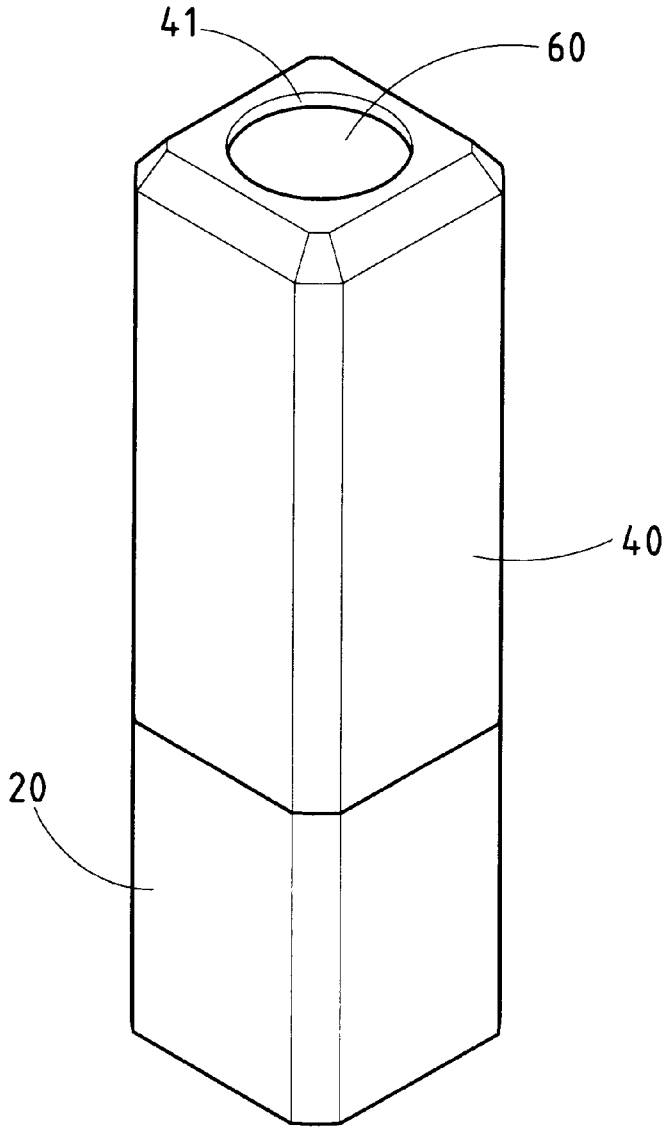
FIG. 2 shows a perspective view of the present invention.
Figure 3:
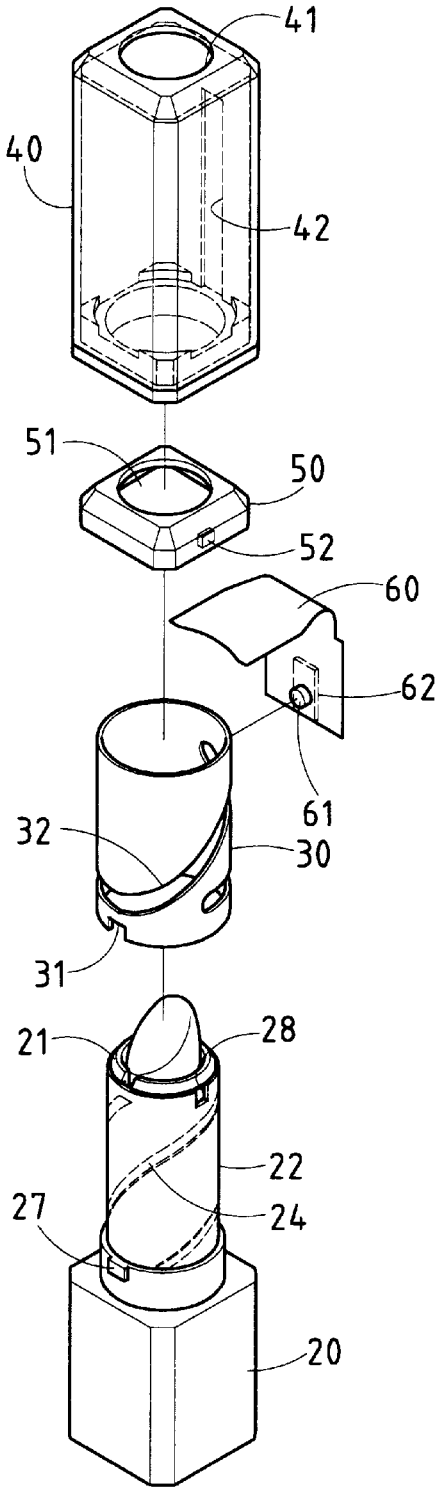
FIG. 3 shows an exploded perspective view of the present invention.
Figure 4:
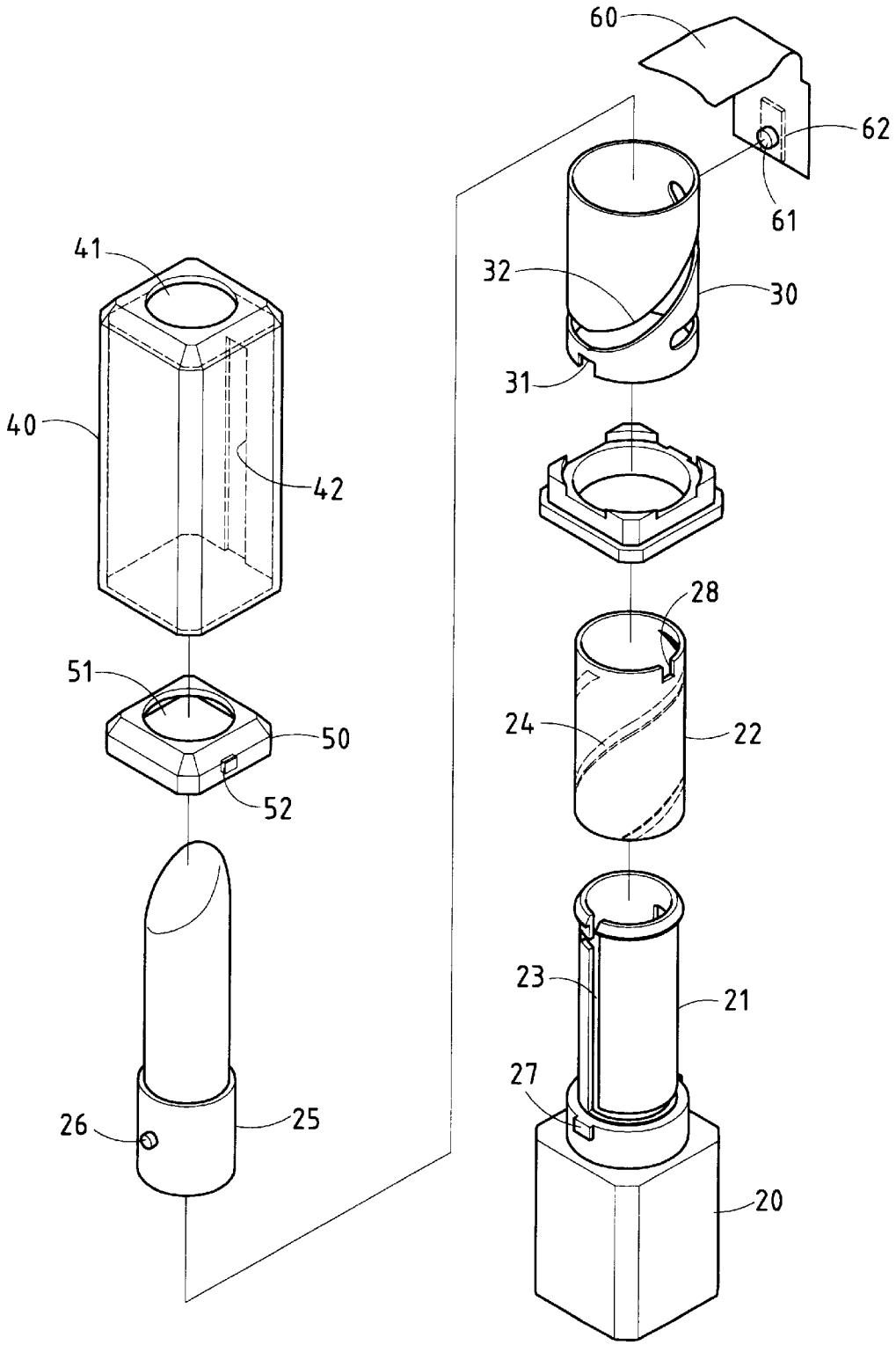
FIG. 4 shows another exploded perspective view of the present invention.

As shown in FIGS. 2–8, a lipstick case structure of the present invention comprises a base 20, an upright tube 21, a rotary tube 22, a guide tube 30, a casing 40, a guide seat 50, and a flexible cover 60.

The upright tube 21 is extending uprightly from the top of the base 20 such that the upright tube 21 is fitted into the rotary tube 22.

The upright tube 21 is provided with an upright slot 23. The rotary tube 22 is provided with a spiral guide slot 24. The upright tube 21 is provided therein with a lipstick mount 25 which is provided with two projections 26. One of the projections 26 is received in the upright slot 23 while other one of the projections 26 is received in the spiral guide slot 24. The lipstick mount 25 is moved up and down by turning the rotary tube 22.

The guide tube 30 is fitted over the rotary tube 22 and is provided at the bottom end with a retaining slot 31 corresponding in location to a retaining block 27 of the top end of the base 20. The inner wall of the guide tube 30 is separated from the outer wall of the rotary tube 22. The guide tube 30 is further provided with a spiral guide slot 32.

The casing 40 is fitted over the guide tube 30 and is provided at the top end with an opening 41 through which the lipstick is moved out of the casing 40 at the time when the lipstick mount 25 is raised. The casing 40 is provided in an inner wall with an upright guide slot 42.

The guide seat 50 is disposed between the top end of the upright tube 21 and the opening 41 of the casing 40. The guide seat 50, the casing 40, and the base 20 are similar in cross sectional form, which may be of any geometric form. The guide seat 50 is capable of turning along with the casing 40. The guide seat 50 is provided with a through hole 51 corresponding in location and shape to the opening 41 of the casing 40. The guide seat 50 is provided in the outer wall of one side with a protuberance 52, which is retained in a recess 28 of the top end of the rotary tube 22 so as to enable the rotary tube 22 to turn along with the guide seat 50.

Figure 7:
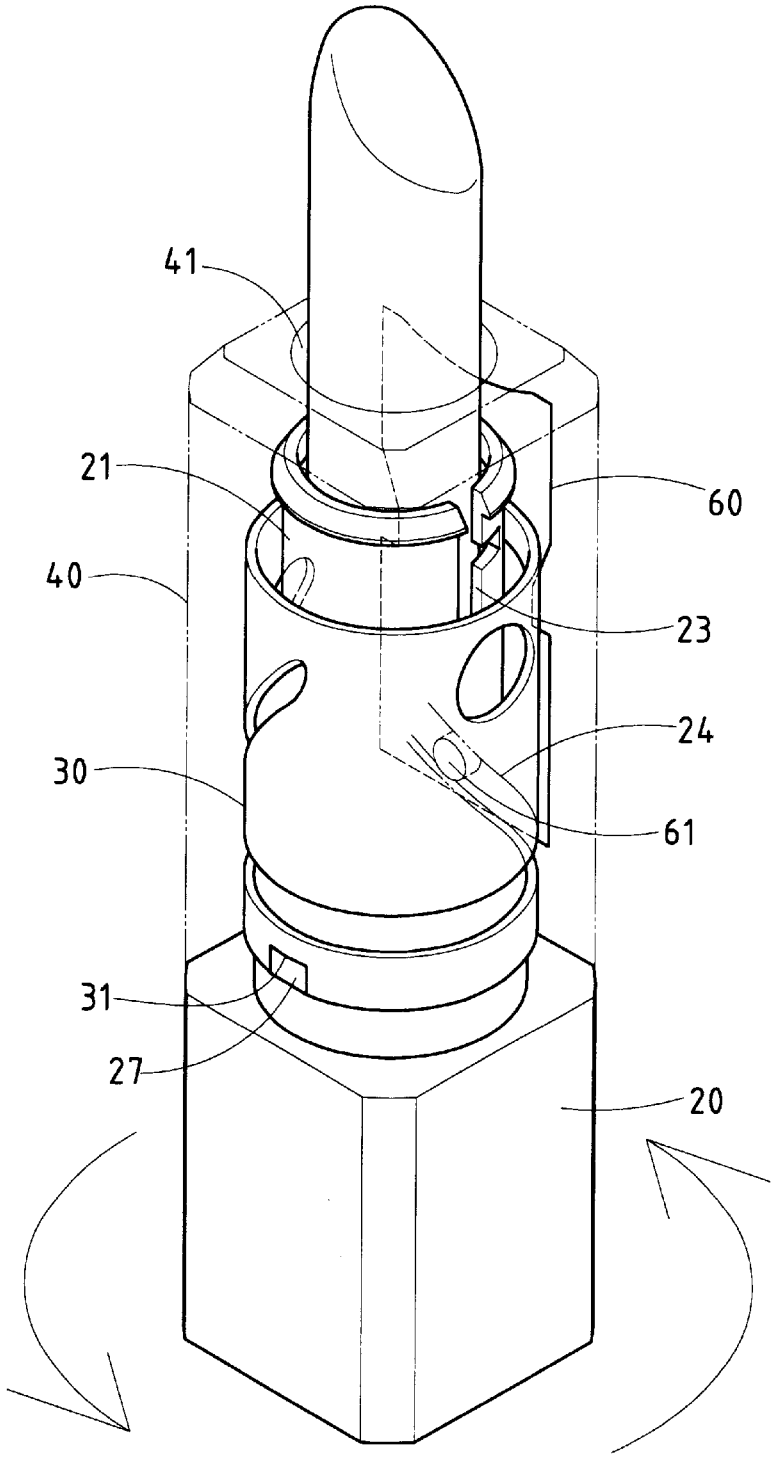
FIG. 7 shows another schematic view of the present invention at work.
Figure 8:
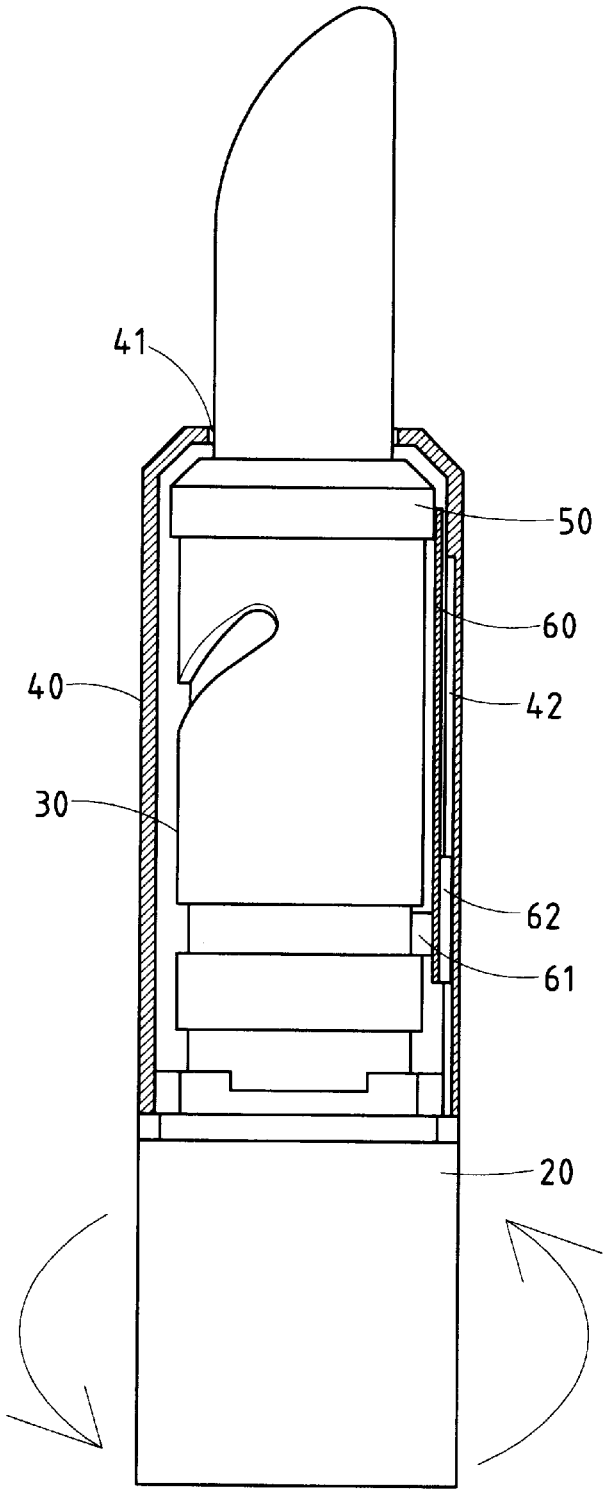
FIG. 8 shows a longitudinal sectional view of the present invention as shown in FIG. 7

The flexible cover 60 is movably disposed between the inner wall of one side of the casing 40 and the outer wall of the guide tube 30. The flexible cover 60 is provided at the bottom end with a protrusion 61, which is slidably received in the spiral guide slot 32 of the guide tube 30. The flexible cover 60 is further provided with a protruded block 62 which is opposite to the protrusion 61 and is slidably received in the upright guide slot 42 of the casing 40. As the casing 40 and the guide tube 30 are changed in their relative position, the flexible cover 60 moves up along the spiral guide slot 32, so as to locate between the opening 41 and the through hole 51. On the other hand, the flexible cover 60 moves down to locate between the inner wall of the casing 40 and the outer wall of the guide tube 30, thereby allowing the lipstick to move through the through hole 51 and the opening 41, as shown in FIGS. 7 and 8. The flexible cover 60 of the present invention is made of a material having an appropriate flexibility, such as a plastic material having a flexibility.

Figure 5:
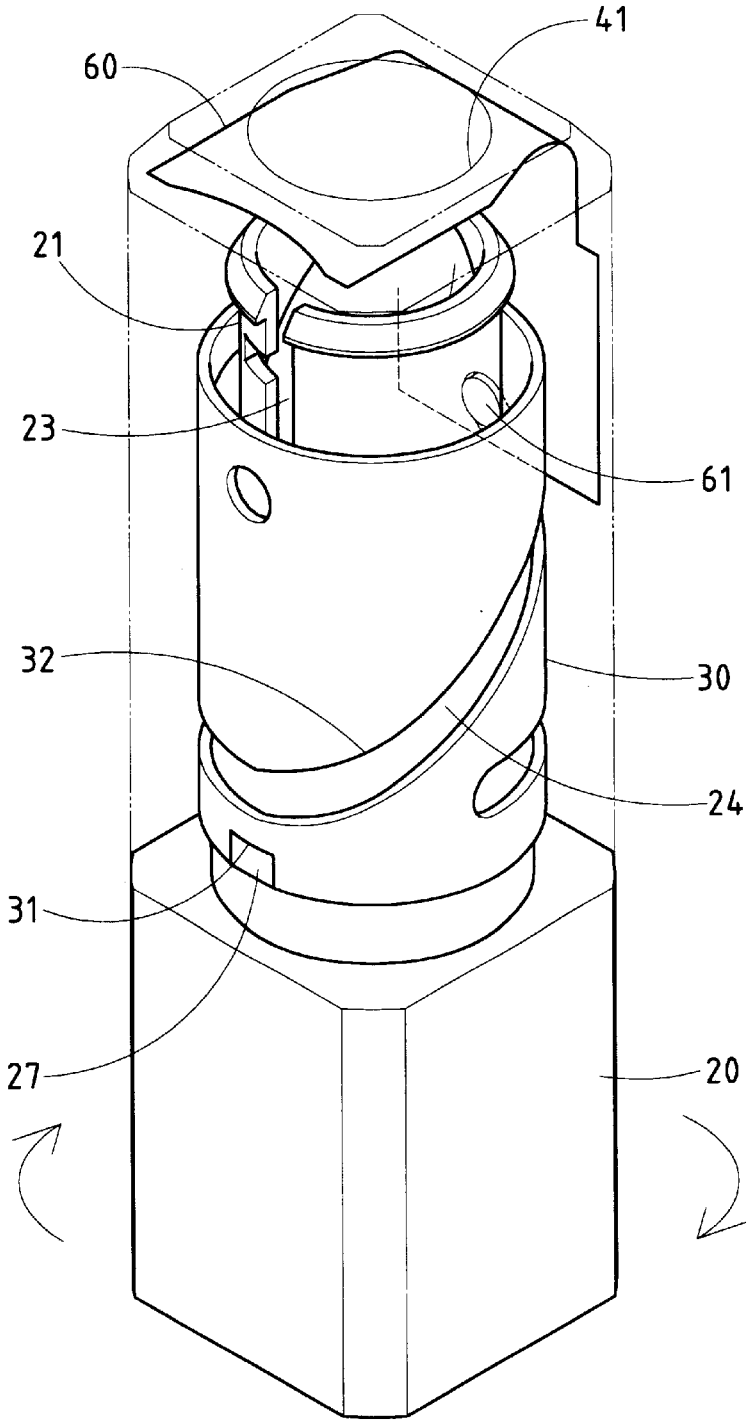
FIG. 5 shows a schematic view of the present invention at work.
Figure 6:
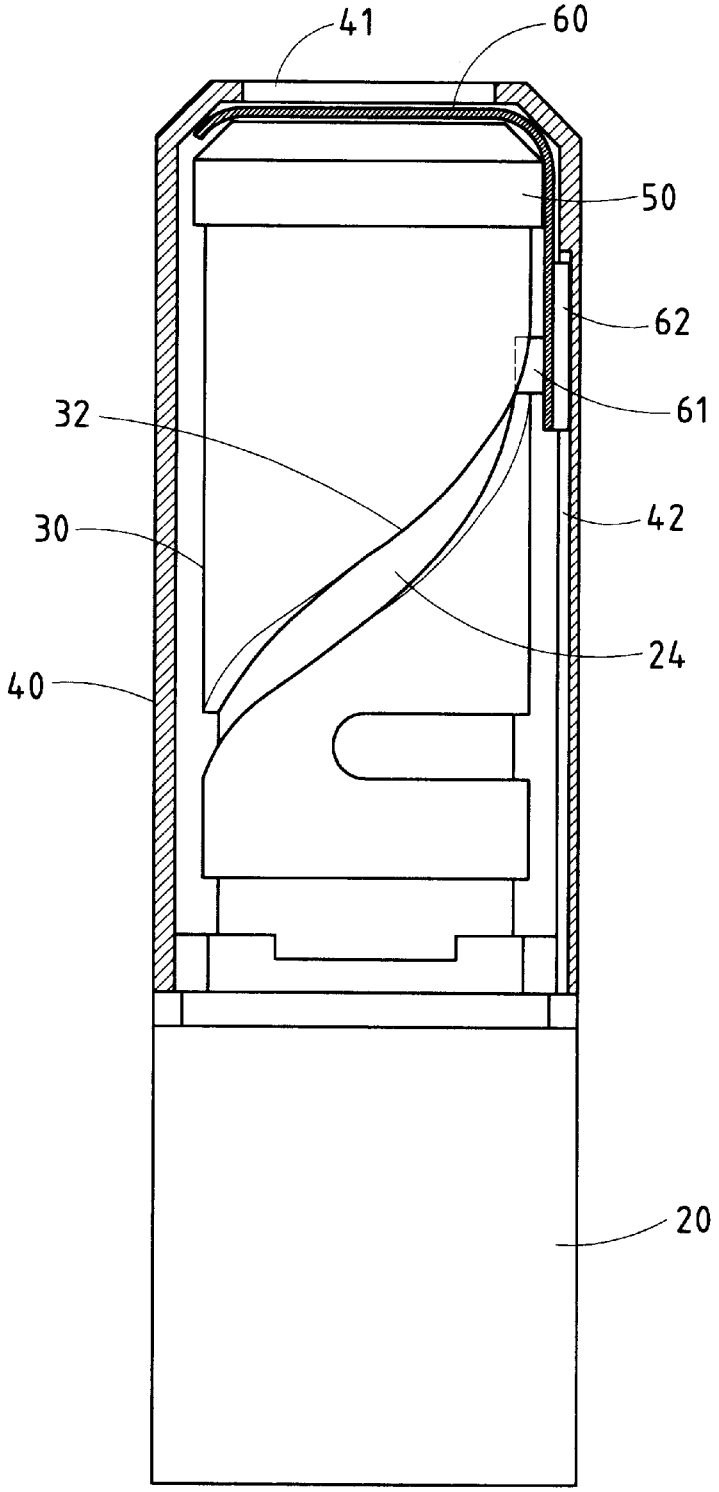
FIG. 6 shows a longitudinal sectional view of the present invention as shown in FIG. 5.

As illustrated in FIGS. 5 and 6, the base 20 is turned clockwise such that the guide tube 30 is driven to turn clockwise, thereby resulting in the upward movement of the protrusion 61 of the flexible cover 60 along the spiral guide slot 32 such that the upper end portion of the flexible cover 60 obstructs the opening 41 of the casing. In the meantime, the upright tube 21 and the rotary tube 22 turn in relation to each other, thereby resulting in the downward movement of the lipstick mount 25.

As illustrated in FIGS. 7 and 8, when the base 20 is turned counterclockwise, the protrusion 61 of the flexible cover 60 moves downward along the spiral guide slot 32, thereby resulting in the departure of the upper end portion of the flexible cover 60 from the opening 41 of the casing 40. In the meantime, the lipstick mount 25 moves upward along with the relative motion of the rotary tube 22 and the upright tube 21 such that the lipstick is emerged from the casing 40 via the opening 41 of the casing 40.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A lipstick case structure comprising:

a base provided at a top end with an upright tube which is provided with an upright slot;

a rotary tube rotatably fitted over said upright tube and comprised of, in a wall, a spiral guide slot;

a lipstick mount movably disposed in said upright tube and provided in the outer wall with two projections which are respectively received in said upright slot of said upright tube and said spiral guide slot of said rotary tube whereby said lipstick mount moves up and down along with said rotary tube in motion;

a guide tube fitted over said rotary tube and comprised of a retaining slot engaged with a retaining block of said base, said guide tube further comprised of a spiral guide slot;

a casing fitted over said guide tube and provided at a top end with an opening corresponding in location to said lipstick mount, said casing further provided in an inner wall of one side thereof with an upright guide slot;

a guide seat disposed between a top end of said upright tube and said opening of said casing such that said guide seat moves along with said casing, said guide seat being comprised of a through hole corresponding in location and shape to said opening of said casing, said guide seat being further comprised of a protuberance whereby said protuberance is retained in a recess of said rotary tube, thereby enabling said rotary tube to turn along with said guide seat; and a flexible cover movably disposed between an inner wall of one side of said casing and an outer wall of said guide tube, said flexible cover comprising, at a bottom end, a protrusion and a protruded block, said protrusion being slidably received in said spiral guide slot of said guide tube, and said protruded block being slidably received in said upright guide slot of said casing whereby said flexible cover moves along with said casing and said guide tube such that said flexible cover moves to obstruct said opening of said casing and said through hole of said guide seat, and that said flexible cover moves away from said opening of said casing and said through hole of said guide seat so as to keep said opening and said through hole clear.

2. The lipstick case structure as defined in claim 1, wherein said base, said guide seat, and said casing are corresponding in cross-sectional shape to one another.

3. The lipstick case structure as defined in claim 1, wherein said flexible cover is comprised of a plastic material having a flexibility.

* * * * *